United States Patent [19]

Gundlach et al.

[11] Patent Number: 4,841,146

[45] Date of Patent: Jun. 20, 1989

[54] SELF-CLEANING SCOROTRON WITH FOCUSED ION BEAM

[75] Inventors: Robert W. Gundlach, Victor; Richard F. Bergen, Ontario, both of N.Y.

[73] Assignee: Xerox Corporation, Stamford, Conn.

[21] Appl. No.: 81,068

[22] Filed: Aug. 3, 1987

[51] Int. Cl.[4] ..... H01T 19/04

[52] U.S. Cl. ..... 250/324; 250/326; 361/230

[58] Field of Search ..... 250/324, 325, 326; 361/230; 355/3 CH

[56] References Cited

U.S. PATENT DOCUMENTS

| | | | |
|---|---|---|---|
| 2,836,725 | 5/1958 | Vyverberg | 250/326 |
| 3,324,291 | 6/1967 | Hudson | 250/325 |
| 3,396,308 | 8/1968 | Whitmore | 250/326 |
| 3,598,991 | 8/1971 | Nost | 250/326 |
| 3,794,839 | 2/1974 | Hayne | 250/325 |
| 3,862,420 | 1/1975 | Bank et al. | 250/324 |
| 4,053,769 | 10/1977 | Nishikawa et al. | 250/324 |
| 4,086,650 | 4/1978 | Davis et al. | 361/229 |
| 4,088,892 | 5/1978 | Plumadore | 250/325 |
| 4,100,411 | 7/1978 | Davis | 250/324 |
| 4,155,093 | 5/1979 | Fotland | 346/159 |
| 4,174,170 | 11/1979 | Yamamoto et al. | 355/3 TR |
| 4,227,233 | 10/1980 | Nishikawa et al. | 250/324 |
| 4,463,363 | 7/1984 | Gundlach et al. | 346/159 |
| 4,524,371 | 6/1985 | Sheridon et al. | 346/159 |
| 4,585,320 | 4/1986 | Altavela et al. | 355/3 |
| 4,585,322 | 4/1986 | Reale | 355/3 |
| 4,585,323 | 4/1986 | Ewing et al. | 355/3 |
| 4,591,713 | 5/1986 | Gundlach et al. | 250/326 |
| 4,745,282 | 5/1988 | Tagaawa et al. | 250/326 |

FOREIGN PATENT DOCUMENTS

| | | | |
|---|---|---|---|
| 2743012 | 3/1979 | Fed. Rep. of Germany | 355/3 CH |
| 54-156546 | 12/1979 | Japan . | |
| 55-73070A | 2/1980 | Japan . | |

*Primary Examiner*—Eugene R. LaRoche
*Assistant Examiner*—Seung Ham
*Attorney, Agent, or Firm*—William A. Henry, II

[57] ABSTRACT

A self cleaning charging unit includes an insulating housing and a current limited, low capacitance corona wire positioned within the housing and located 0.5–6 mm away from biased conductive plates which form a slit through the bottom of the housing that allows ions to pass therethrough onto a receptor surface. The conductive plates are used to control the flow of ions through the slit and opposing insulating wedges are positioned above and incontacting relationship with each conductive plate in order to focus additional ions to the center of the slit. At inside edges of the slit there are additional fringe fields that aid in pumping ions out of the slit. Charging a receiver in corotron or scorotron fashion is possible with this charging unit.

7 Claims, 3 Drawing Sheets

SELF-CLEANING SCOROTRON WITH FOCUSED ION BEAM

Reference is hereby made to commonly assigned copending application, Attorney's Docket D/86055, Ser. No. 080,852, of Robert W. Gundlach and Richard R. Bergen, filed Aug. 3, 1987, and entitled "Printing Apparatus With Improved Ion Focus", which is incorporated herein by reference.

This invention relates to a novel ion charging apparatus wherein ions are generated in a housing and focused through a narrow conducting exit slit in order to uniformly charge a charge receptor.

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charge to the receiver more efficiently, but compromises the control function of the device.

Other methods exist for trying to obtain uniform charging from negative charging systems such as dicorotron charging devices as shown in U.S. Pat. No. 4,086,650 that includes glass coated wires and large specialized AC power supplies. A simpler system involves a screened corotron (scorotron). However, these methods are well known for being inefficient charging units, requiring slower charging speeds, and providing marginal uniformity.

Various ion generating devices are available for printing or charging purposes. For example, in U.S. Pat. No. 4,463,363 there is taught a D.C. air breakdown form of ion generator. In U.S. Pat. No. 4,524,371 a fluid jet assisted ion projection printing apparatus is disclosed that includes a housing having ion generation and ion modulation regions. A bent path channel, disposed through the housing, directs transport fluids with ions entrained therein adjacent an array of modulation electrodes which control the passage of ion beams from the device. Emission of charged particles in U.S. Pat. No. 4,155,093 is accomplished by extracting them from a high density source provided by an electrical gas breakdown in an alternating electrical field between two conducting electrodes separated by an insulator. A corona discharge unit is used in conductive toner transfer in a copier in U.S. Pat. No. 4,174,170. The corona discharge unit includes a slit to permit transfer of conductive toner particles onto a copy paper charged by the corona unit. A corona wire in the unit is surrounded by a shield. U.S. Pat. No. 3,396,308 discloses a web treating device for generating a flow of ionized gas. This device includes an opening through which the gas is directed towards a receptor surface. An elongated hollow housing 11 has tapered sides 14 terminating in a pair of lips 15 which form a narrow and elongated slot 16. U.S. Pat. Nos. 3,598,991 and 4,100,411 show electrostatic charging devices including a corona wire surrounded by a conductive shield. In U.S. Pat. No. 3,598,991, a slit 13 is formed in the shield to allow ions to flow from wire 12 to a photoconductive surface 2 to deposit an electric charge thereon. In U.S. Pat. No. 4,100,411, a pair of lips 16 and 17 define a corona ion slit 18. Japanese Patent Document No. 55-73070 discloses a powder image transfer type electrostatic copier that includes a corona discharge device having a slit in a shield plate. In Japanese Patent Document No. 54-156546 a corona charge is shown having a plurality of grating electrodes in the opening part of a corona shield electrode. These devices have not been entirely satisfactory in that they are costly, some of them are hard to fabricate and most are inefficient.

Accordingly, a charging apparatus that is simpler and more efficient, more compact, easier to keep clean, is useful in situations when one wants current to be applied over a narrow band, and charges at higher density is disclosed that includes a current limited, low capacitance corona wire, mounted within an insulated housing and located 1–2 mm away from conductive shims oppositely positioned on the bottom of the housing to form a slit for the emitting of ions to a receptor surface. The housing has beveled insulating shields that focus additional ions into the slit.

Other features of the present invention will become apparent as the following description proceeds and upon reference to the drawings in which.

Figure 1:
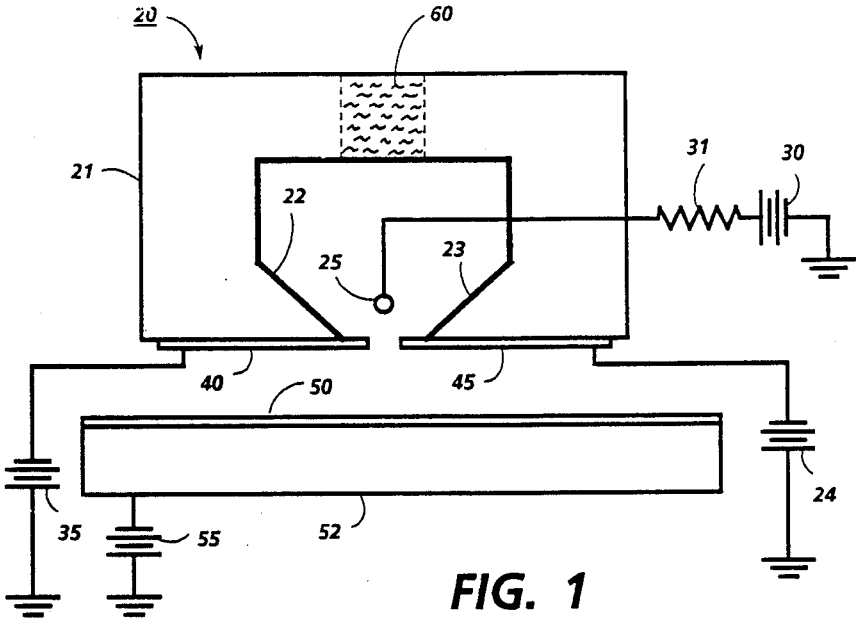
FIG. 1 is an enlarged elevational view of a self-cleaning charging unit that incorporates insulating wedges in the unit in accordance with one aspect of the present invention.

While the invention will be described hereinafter in connection with preferred embodiments, it will be understood that no intention is made to limit the invention to the disclosed embodiments. On the contrary, it is intended to cover all alternatives, modifications, and equivalents as may be included within the spirit and scope of the invention as defined by the appended claims.

For a general understanding of the features of the invention, reference is had to the drawings. In the drawings, like reference numerals have been used throughout to designate identical elements.

Figure 2:
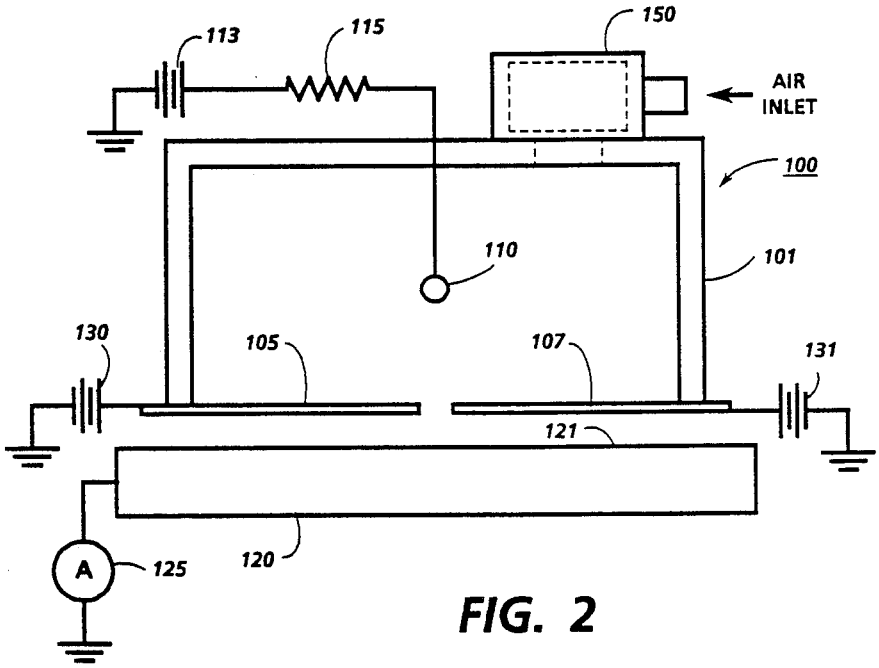
FIG. 2 is an enlarged cross-section of an alternative self-cleaning charging unit in accordance with the present invention.

Now turning to the present invention, it has been found that the screen reference electrode in U.S. Pat. No. 4,591,713 can be replaced by a single slit of about ½ to 4 mm width and a thickness of less than the slit width without losing noticeable charging efficiency. A screen reference electrode 82 is shown in FIG. 2 of U.S. Pat. No. 4,591,713 that is positioned about 1.5 mm away from a photoconductive surface. The screen has about 30 to 65% open areas and a thickness of about 3 to 5 mils. This spacing is sufficiently close to the photoconductive surface that fringing fields between the screen and the photoconductive surface contribute to efficient ion pumping as well as potential leveling on the photoconductive surface. FIG. 1 of the present invention is essentially the same device except with two reference electrodes forming a conducting slit to replace the conducting screen 82 of FIG. 2 in U.S. Pat. No. 4,591,713.

In addition, scorotrons of the prior art generally produce corona winds, the result of ions generated by the coronode(s) being driven out of the scorotron by the strong fields extending from the coronode to and through the screens. The momentum of the accelerating ions is transferred to the surrounding air to create a gentle pumping action of air out of the scorotron. At the same time, all air being pumped out of the unit must be replaced by other air flowing into the unit. U.S. Pat. No. 3,324,291 teaches the use of an insulating filter to repel charges and allow clean air to enter through it into the back of the corona charging unit. These principles can be applied to the present invention, or an external fan or blower can be employed to ensure that clean air exits the slit with the ion stream with sufficient velocity to prevent any turbulent air from carrying toner, or paper dust, or the like into the scorotron of the present invention. The slit scorotron, in fact, enables the use of ammonia filters to preclude the presence of ammonia gases within the ion generating chamber, thereby eliminating the buildup of detrimental nitrate byproducts on conducting surfaces of the coronode and reference electrodes of the scorotron.

In particular reference to FIG. 1 of the present invention, a novel charging unit 20 is shown that includes an insulating rectangular housing 21 of a material such as plexiglass. Conducting electrodes 40 and 45 are attached by conventional means to the bottom of the housing 21 and define a slit or opening through which ions from coronode 25 are emitted. A positive high voltage power supply 30 furnishes the current that flows through resistor 31 supplying energy to coronode 25. A charge retentive surface 50 is mounted on conductive substrate 52 which could be biased by battery 55 if desired. Current limited, low capacitance wire 25 is located very close (1.5–5 mm) to the conductive electrodes 40 and 45 that form the slit. Insulating shields in the form of beveled wedges 22 and 23 are provided to focus additional ions to the center of the slit. The beveled insulators acquire charges that produce fields to drive additional ions toward and into the slit. At the slit edges (inside) there are additional fringe fields that aid in pumping ions out of the slit. Since the charging unit of the present invention has fields that are directed toward the slit, there is preferential air flow toward and out of the slit. By allowing replacement air to enter through low impedance filter 60, a clean, positive air flow is assured.

In accordance with another aspect of this invention, FIG. 2 depicts a novel charging unit 100 that comprises an insulating housing 101 that is rectangular in shape with 1 mil conductive plate 105 and 107 provided as a bottom portion thereof. The conductive plates form a slit in the housing that varies from about 10 mils to about 50 mils and is biased by potential sources 130 and 131. A corona emission coronode 110 of 1.5 mil diameter wire is energized by an energy source 113 through a 10m Ω resistor 115 in order to emit ions out of the slit formed between the two plates 105 and 107 onto insulated receiver surface 121, which is positioned on top of grounded conductive substrate 120. Conductive plates 105 and 107 are spaced 60 mils away from receiver surface 121 while coronode 110 is spaced about 120 mils away from conductive plates 105 and 107. A low impedance filter in housing 150 allows replacement air to enter the housing 101 and thereby assures a clean positive air flow that prevents toner and paper dust from entering the device while replacing air leaving the device due to the corona wind effects.

Figure 3:
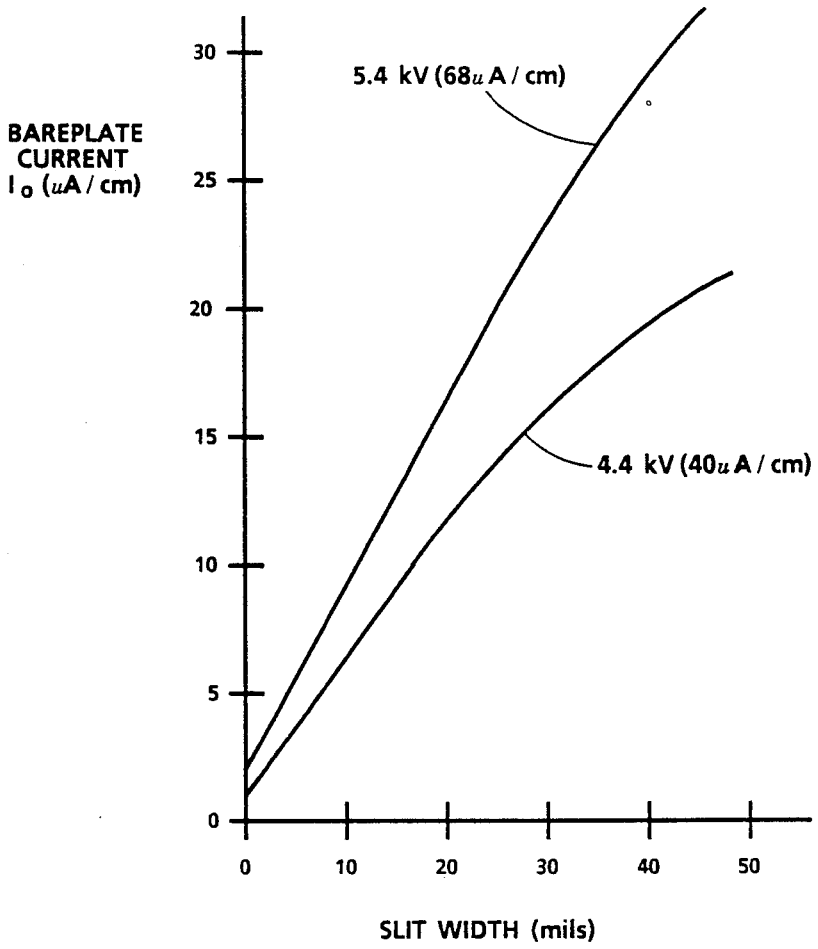
FIG. 3 is a diagram showing some of the operating characteristics of the charging unit of FIG. 2.

With the coronode wire 110 biased above corona threshold, ions are generated that flow toward the biased conductive plates. Some ions are then pumped by the fringing fields, through the potential well in the slit, where they follow the field lines to the receiver surface. As the potential of the receiver surface builds up to the voltage applied to the plates, the fringing fields collapse and the field lines from the coronode terminate on the conductive plates, thereby driving the ions to the plates and limiting the receiver surface to that potential. Typically, this gives an efficiency of between 30–50%. In the past, relatively large scorotron units have employed a high percentage of open areas within their screens. Conductive shields were required because of the large spacings and high percentage openings, to keep the corona wires above threshold. However, with corona generator 110 the coronode is separated from the slit by approximately 3 mm. The conductive plates have a fixed voltage applied to them so that the coronode can keep above threshold due to the proximity and area of the plates; therefore, a conductive shield is not necessary to maintain corona. FIG. 3 depicts positive bareplate current as a function of slit width for two coronode current levels of 4.4 kV and 5.4 kV. It is clear that with a 45 mil slit width nearly 50% of the total current is flowing to the bareplate.

Charging units can be built with a narrow slit of between 1 and 2 mm, instead of a screen, (such as the 65% open screens covering 10 mm to 20 mm channels). A housing 150 in FIG. 2 includes an air inlet opening into a filter situated within housing 150 can be attached to body 100. This housing permits control of the environment, especially the moisture content of the air surrounding the coronode. Corona wind is utilized to pump air through the cavity, however, a pump could also be used if desired. The positive air flow into the air inlet is filtered and exits out of the slit thereby insuring a minimum of toner flow into the corona cavity during operation of copying equipment. The presence of toner and/or nitrate build-up on the inside surface of screen electrodes exacerbates arcing and/or loss of control of receptor surface potential.

Figure 4:
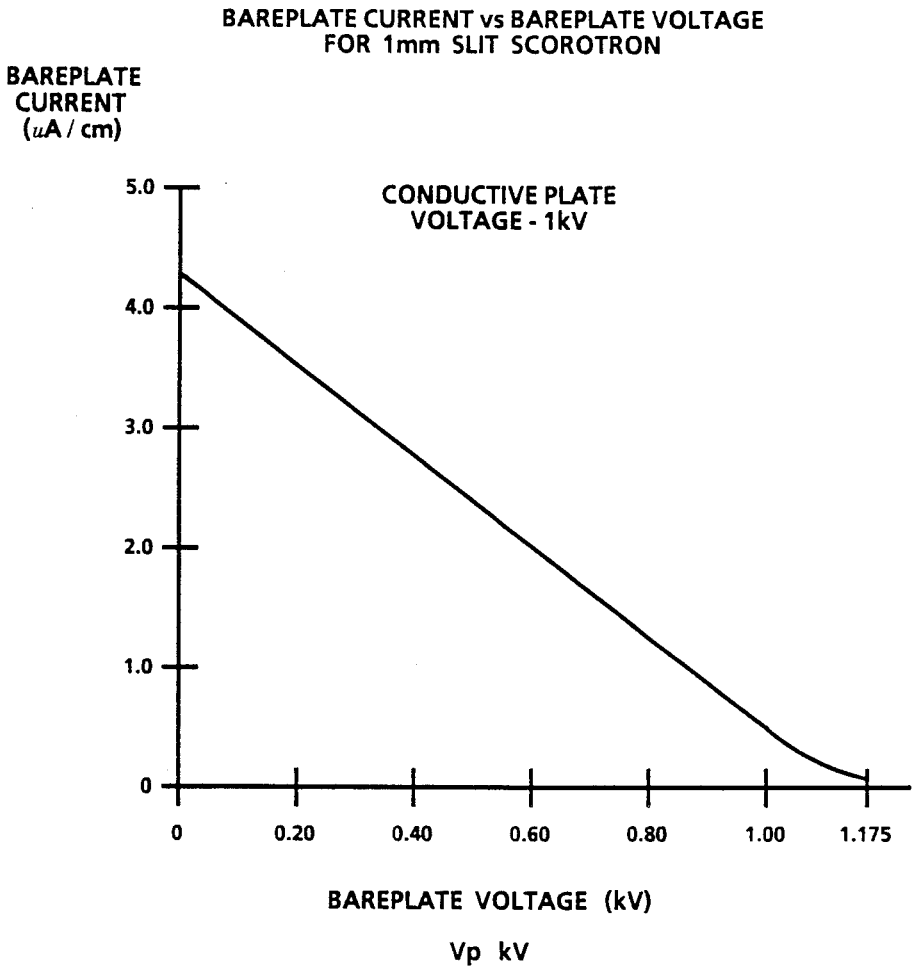
FIG. 4 is a diagram depicting bareplate current versus bareplate voltage for a 1 mm slit scorotron in accordance with an aspect of the present invention.

When the charging unit of FIG. 2 has a 1 mm separation between conductive plates 105 and 107, and is spaced 60 mils from receiver 120, a useful scorotron charging device results. When the receiver has a bias applied to it, the driving fields alter the ion current exiting the slit. Eventually, the receiver voltage reaches the level where the current flow to the receiver ceases. This is a receptor's asymptote voltage. It is at this point that all of the ions are flowing to the conductive plates. For scorotron charging, the receiver's asymptote voltage and the voltage of the conductive plates are nearly identical. FIG. 4 shows an asymptote voltage of 1175 for the 1000 volts applied to the conductive plates. This 175 volt difference can be reduced by narrowing the slit, e.g., a 0.75 mm slit will have an asymptote voltage of 1 kV.

While the invention has been particularly shown and described with reference to preferred embodiments thereof, it will be understood by those skilled in the art that various changes in form and details may be made therein without departing from the spirit and scope of the invention.

What is claimed is:

1. A self-cleaning scorotron charging apparatus adapted to uniformly charge a surface of a charge receptor substrate with either negative or positive ions, said charging apparatus being characterized by including:

a substantially enclosed insulating housing including top, side and bottom, surfaces;

electrode means positioned on said bottom surface of said insulating housing and adapted to form a slit therein, and coronode means within said insulating housing adapted to emit ions through said slit onto said charge receptor, said insulating housing having wedge shaped interior portions that are slanted toward said slit so as to focus additional ions from said coronode means to the center of said slit and thereby increase the efficiency of said charging apparatus.

2. The apparatus of claim 1, wherein said coronode means is about 0.5–6 mm away from said electrode means.

3. The apparatus of claim 2, wherein a potential difference is applied between said electrode means and said charge receptor substrate.

4. The apparatus of claim 3, including high voltage means connected to said coronode means through current limiting resistance means.

5. The apparatus of claim 1, wherein said electrode means has a thickness not substantially greater than the slit separation of said electrode means.

6. A scorotron charging apparatus, comprising:

an insulating housing;

a charge retentive surface;

a pair of electrode means forming one portion of said housing, said pair of electrode means being spaced from each other to form a slit therebetween of about 0.25 to about 3 mm; and coronode means positioned adjacent said slit within said housing at a distance of about 60 mils away from said charge retentive surface.

7. A self-cleaning scorotron charging apparatus adapted to uniformly charge a surface of a charge receptor substrate with either negative or positive ions, said charging apparatus being characterized by including:

a substantially enclosed insulating housing including top, side and bottom, surfaces;

electrode means positioned on said bottom surface of said insulating housing and adapted to form a slit of about 0.25 to about 3 mm therein, and coronode means within said insulating housing adapted to emit ions through said slit onto said charge receptor, said insulating housing having wedge shaped interior portions that are slanted toward said slit so as to focus additional ions from said coronode means to the center of said slit and thereby increase the efficiency of said charging apparatus, and wherein said coronode means is about 60 mils away from said charge receptor surface and about 0.5 to 6 mm away form said electrode means.

* * * * *